US009932145B1

(12) United States Patent
Jeon et al.

(10) Patent No.: US 9,932,145 B1
(45) Date of Patent: Apr. 3, 2018

(54) SYSTEM AND METHOD FOR AUTOMATICALLY PACKAGING ITEM(S) AND ASSOCIATED PACKAGES

(71) Applicant: Amazon Technologies, Inc., Reno, NV (US)

(72) Inventors: Kijin Jeon, Tokyo (JP); Masahiro Uchida, Osaka (JP)

(73) Assignee: Amazon Technologies, Inc., Reno, NV (US)

( * ) Notice: Subject to any disclaimer, the term of this patent is extended or adjusted under 35 U.S.C. 154(b) by 18 days.

(21) Appl. No.: 14/456,752

(22) Filed: Aug. 11, 2014

(51) Int. Cl.
*B65D 21/02* (2006.01)
*B65D 77/04* (2006.01)
*B65D 65/02* (2006.01)

(52) U.S. Cl.
CPC ..... *B65D 21/0233* (2013.01); *B65D 65/02* (2013.01); *B65D 77/046* (2013.01)

(58) Field of Classification Search
USPC ..... 206/521, 522, 588, 589, 593; 220/523, 220/526, 528, 521, 522, 666
See application file for complete search history.

(56) References Cited

U.S. PATENT DOCUMENTS

2010/0255162 A1* 10/2010 Becraft ..... B65D 81/2076 426/264
2011/0068042 A1* 3/2011 Palumbo ..... B65B 11/52 206/557
2011/0086141 A1* 4/2011 Strilich ..... B65D 75/305 426/110
2015/0375893 A1* 12/2015 Korinek ..... B65D 5/503 493/90

* cited by examiner

*Primary Examiner* — James N Smalley
*Assistant Examiner* — Madison L Poos
(74) *Attorney, Agent, or Firm* — Seed IP Law Group LLP

(57) ABSTRACT

A system and a method for automatically packaging item(s) are disclosed, as well as associated packages. The method includes generally four steps. First, an outer tray containing one or more item(s) is received. Second, an inner tray is placed in the outer tray over the one or more item(s), and the inner tray includes a plurality of preformed columnar compartments. Third, the inner tray and the outer tray are sealed to form at least a partial vacuum between an exterior surface of the inner tray and an interior surface of the outer tray. The item(s) are firmly secured in the at least partial vacuum such that the item(s) will not shift within the package during shipment. Fourth, a cover is placed over the inner tray to close the plurality of preformed columnar compartments to thereby form a plurality of air compartments, which collectively protect the item(s) from external impact.

20 Claims, 8 Drawing Sheets

SYSTEM AND METHOD FOR AUTOMATICALLY PACKAGING ITEM(S) AND ASSOCIATED PACKAGES

BACKGROUND

Electronic marketplaces, such as those accessible via the Internet, may include a catalog of items or products available for purchase. These items may be offered as the basis for commerce (e.g., sale or trade). In one example, customers may utilize a web browser to visit a merchant's website, select an item for purchase from the catalog, and engage in a checkout process to finalize an order for the item. The merchant may operate a fulfillment network including various facilities in order to process such orders. For instance, the merchant may operate a facility that prepares shipments of purchased items. A shipment carrier may receive such shipments from the merchant and deliver the shipments to the respective purchasing customers.

The facilities operated by the merchant may include various fulfillment processes for fulfilling orders submitted by customers. These processes may operate on items to perform various tasks, such as sorting items, transferring items from one location to another, and preparing items for shipment. As specific examples, items together with a shipping bill may be wrapped (e.g., shrink-wrapped) and placed in a shipping envelope or a box, or may be placed directly in a shipping envelope or a box. At one or more points in these processes, items are carried on a conveyor belt, to be transferred onto another conveyor belt, onto a workstation, or into a sorting bin or a shipment box.

While the system and method for automatically packaging item(s), and associated packages, are described herein by way of example for several embodiments and illustrative drawings, those skilled in the art will recognize that the system and method for automatically packaging item(s), and associated packages, are not limited to the embodiments or drawings described. It should be understood that the drawings and detailed description thereto are not intended to limit the system and method for automatically packaging item(s), and associated packages, to the particular form disclosed, but on the contrary, the invention is to cover all modifications, equivalents and alternatives falling within the scope of the system and method for automatically packaging item(s), and associated packages. The headings used herein are for organizational purposes only and are not meant to be used to limit the scope of the description of the present application. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION

The present invention is directed to providing a system and a method for automatically packaging item(s) in a package, which firmly secures the item(s) within the package such that the item(s) will not shift during shipment. Additionally the package has a superior shock-absorbing characteristic to protect the item(s) in the package from external impact. Aspects of the invention are also directed to the package itself, which comprises a novel combination of pressurized air compartments and sealing that creates at least a partial vacuum arranged to together tightly enclose (wrap around) the item(s). The combination of pressurized air compartments and sealing that creates at least a partial vacuum firmly secures the content (item(s)) within the package and at the same time protects the content from external impact. In one usage example, the system and method for automatically packaging item(s) in a package according to the present invention may be implemented at the packing stage of a merchant's order fulfillment facility where ordered items are selected (retrieved), sorted, and packaged while being carried on one or more conveying devices, e.g., conveyor belts. In another example, the system and method for automatically packaging item(s) in a package according to the present invention may be implemented in a stand-alone packaging station.

Figure 1:
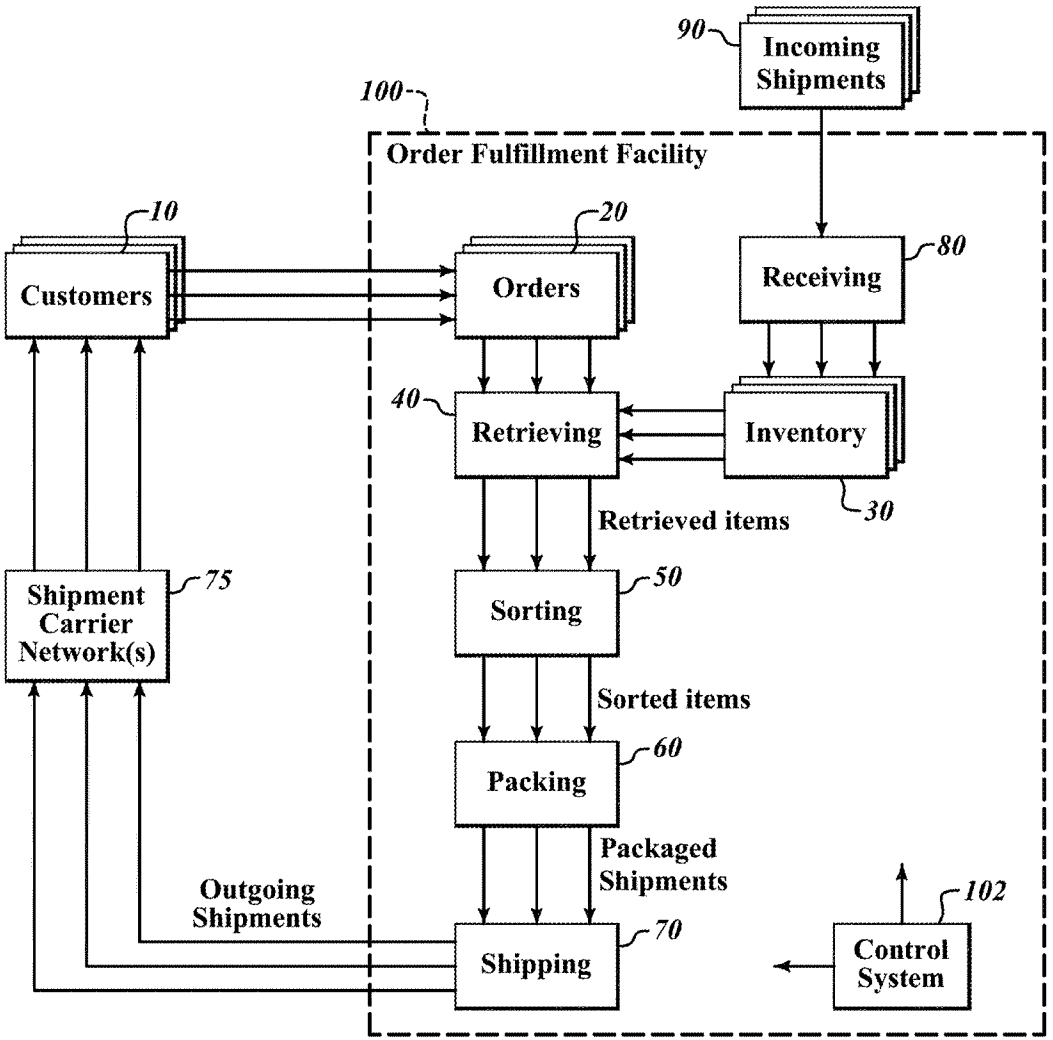
FIG. 1 illustrates a logical representation of the operations of an order fulfillment facility, at the packing stage of which an embodiment of the present invention may be implemented.

In one usage example, embodiments of a system and a method for automatically packaging item(s) may be implemented at the packing stage of a merchant's order fulfillment facility including one or more conveyor belts along which various order-fulfilling operations are performed. FIG. 1 illustrates a logical representation of the operation of an exemplary order fulfillment facility 100, in which the system and method for automatically packaging items(s) may be implemented at its packing stage (see 60) provided along one or more conveyor belts. The order fulfillment facility 100 may be used to fill orders placed through an electronic commerce ("e-commerce") portal.

Multiple customers 10 may submit orders 20 through an ecommerce portal or other electronic marketplace, wherein each order 20 specifies one or more items from inventory 30 to be shipped to the address specified by the customer that submitted the order. The inventory 30 includes incoming shipments 90 that have gone through receiving 80. To fulfill the customer orders 20, the one or more items specified in each order may be retrieved from inventory 30 (which may also be referred to as stock storage) in the retrieving stage, as indicated at 40. Retrieved items may be delivered or conveyed to one or more stations in the order fulfillment facility for sorting 50 into their respective orders with each order placed in a shipping tray, to packing 60, shipping 70, and finally to shipment carrier network(s) 75 to the customers 10. In various embodiments, the system and method for automatically packaging item(s) according to the present invention may be used mainly in the packing stage 60, where products retrieved from the inventory 30 and sorted per order in shipping trays are received, on one or more conveyor belts, to be packaged for shipment. In other embodiments, the system and method for automatically packaging item(s) may be implemented in a stand-alone packaging station.

Figure 2:
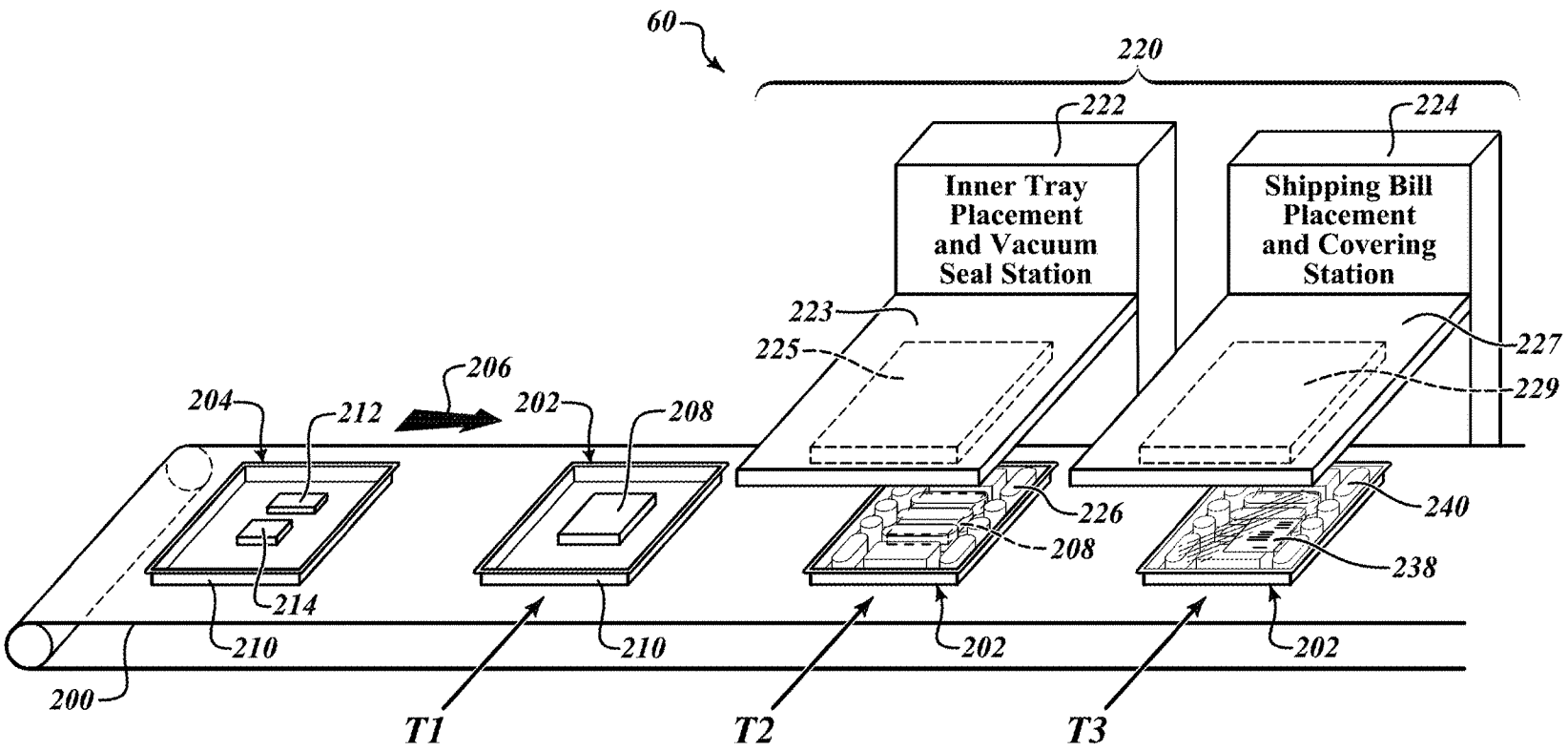
FIG. 2 illustrates a system and method (process-flow including time T1, time T2 and time T3) for automatically packaging item(s) according to an embodiment of the present invention using a conveyor belt.

FIG. 2 is a diagram illustrating a flow of ordered items that have been retrieved and sorted so that each order is placed in a shipping tray, and delivered to the packing stage 60 of the order fulfillment facility 100 on a conveying device, e.g., conveyor belt 200. In The conveyor belt 200 as illustrated carries two orders 202 and 204 moving in the direction of arrow 206. The first order 202 includes one item 208 placed in an outer tray 210, and the second order 204 includes two items 212 and 214 placed in an outer tray 210. Various methods and systems, which are outside the scope of the present invention and are not described in detail, may be used to retrieve ordered items and sort them into different orders respectively placed in different outer trays 210.

Figure 3:
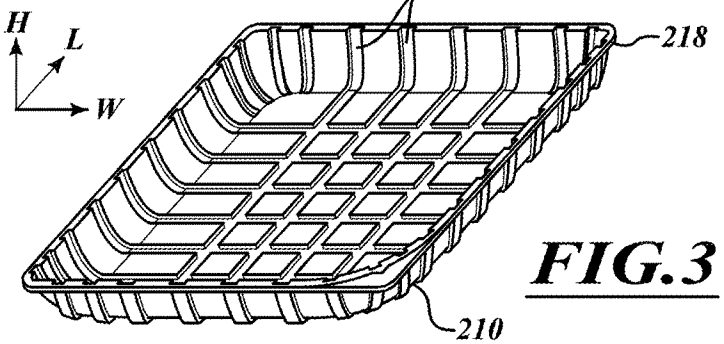
FIG. 3 is a perspective view of an outer tray used to form a package according to one embodiment of the invention.

FIG. 3 is a perspective view of an example of the outer tray 210 for use in one embodiment of the present invention. The outer tray 210 may be made of any suitable material of sufficient rigidity to provide support for the ordered item(s) placed therein. For example, it may be formed of any resin material such as polyethylene terephthalate (PET) or PET recycled material using a die and a suitable heat/vacuum formation technique. Other suitable materials such as polypropylene (PP) material may also be used. The outer tray 210 may be made of transparent material, or made of opaque material so that its content is not visible from outside. In one example, outer dimensions of the outer tray 210 are 26 mm in height, 212 mm in length and 167 mm in width at the bottom (i.e., the lower, closed face) and 235 mm in length and 190 mm in width at the top (i.e., the upper, open face) (thus having a slightly tapering profile from top to bottom), and 450 μm in thickness. As illustrated, the outer tray 210 may include grooves (or ridges) 216 arranged in a grid pattern to add structural strength and rigidity to the outer tray 210. Also as illustrated, the top of the outer tray 210 may include a projecting rim (or brim) 218 extending along the entire periphery of the outer tray 210. The projecting rim 218 may be used to be adhered to a corresponding projecting rim of an inner tray, to be described below, and to that end the width of the projecting rim 218 is suitably selected to provide a sufficient area to form an adhesion, for example, 5 mm to 8 mm in one example. Those skilled in the art should appreciate that the shape, dimensions, and configuration (e.g., arrangement of grooves/ridges 216) of the outer tray 210 as illustrated in FIG. 3 are non-limiting examples only, and various modifications to the shape, dimensions, and configuration may be readily made depending on each application and use. For example, an outer tray may be made smaller or larger, thicker or thinner, have different shapes viewed from the top (square, rectangle, circle, oval, etc.), have different heights (depths), have a variety of surface patterns applied in the form of grooves/ridges or have no surface pattern, etc.

Figure 4:
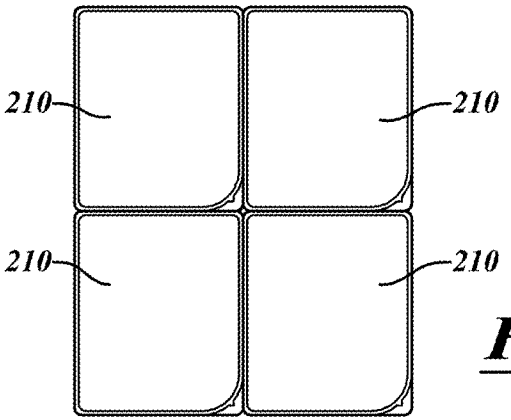
FIG. 4 is a top view of a combination of four outer trays, each for use to form a package, according to another embodiment of the invention.

In one implementation example, two or more outer trays 210 may be combined and formed in one piece, as shown in FIG. 4, with each tray containing one order comprising one or more items. While FIG. 2 illustrates an example in which separate outer trays 210 each containing an order are delivered to the packing stage 60, in another example a combination of multiple outer trays 210, as shown in FIG. 4, may be delivered to the packing stage 60. Then, the system and method for automatically packaging item(s) is applied to each of the outer trays 210 to produce multiple packages, which are thereafter severed along the interfaces between adjacent outer trays 210 into individual packages. The description of the system and method for automatically packaging item(s) applies equally to both of these implementation examples, and each of the combined multiple outer trays 210 may be formed identically or similarly to an individual outer tray 210. For example, multiple combined trays may have the identical dimension and shape, or different dimensions and shapes except for sharing the common height. Thus, a detailed description is omitted of the implementation example in which the combination of multiple outer trays 210 as shown in FIG. 4 is used.

Referring back to FIG. 2, a time sequence of the packaging process applied to the first-arriving order 202 is shown, at times T1, T2, and T3 in the illustrated example. At T1, the order 202 including one ordered item 208 placed in the outer tray 210 is about to be delivered to the packing stage 60, or more specifically, to an automatic packaging system 220 according to an embodiment of the present invention. The automatic packaging system 220 includes an inner tray placement and vacuum seal station 222 and a shipping bill placement and covering station 224 in the illustrated example. In other embodiments, the method/processing of automatically packaging item(s) according to the present invention may be performed in a single station, or may be dividedly carried out in two, three, or more stations, with multiple functions suitably divided amongst multiple stations depending on each implementation. Thus, the configuration of the automatic packaging system 220 as illustrated in FIG. 2 is merely a non-limiting example, and various modifications thereto are apparent to those skilled in the art.

Figure 5:
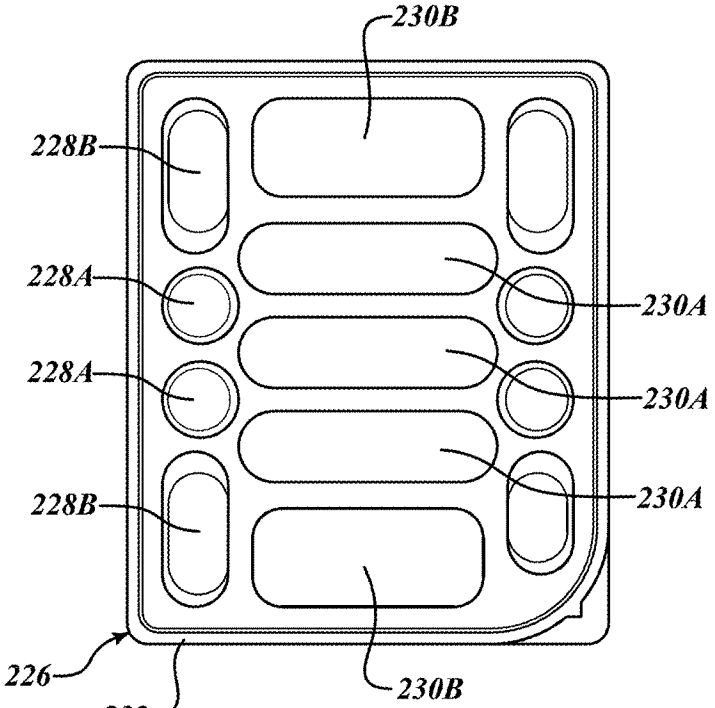
FIG. 5 is a top view of an inner tray, to be received in the outer tray to together form a package, according to one embodiment of the invention.
Figure 6A:
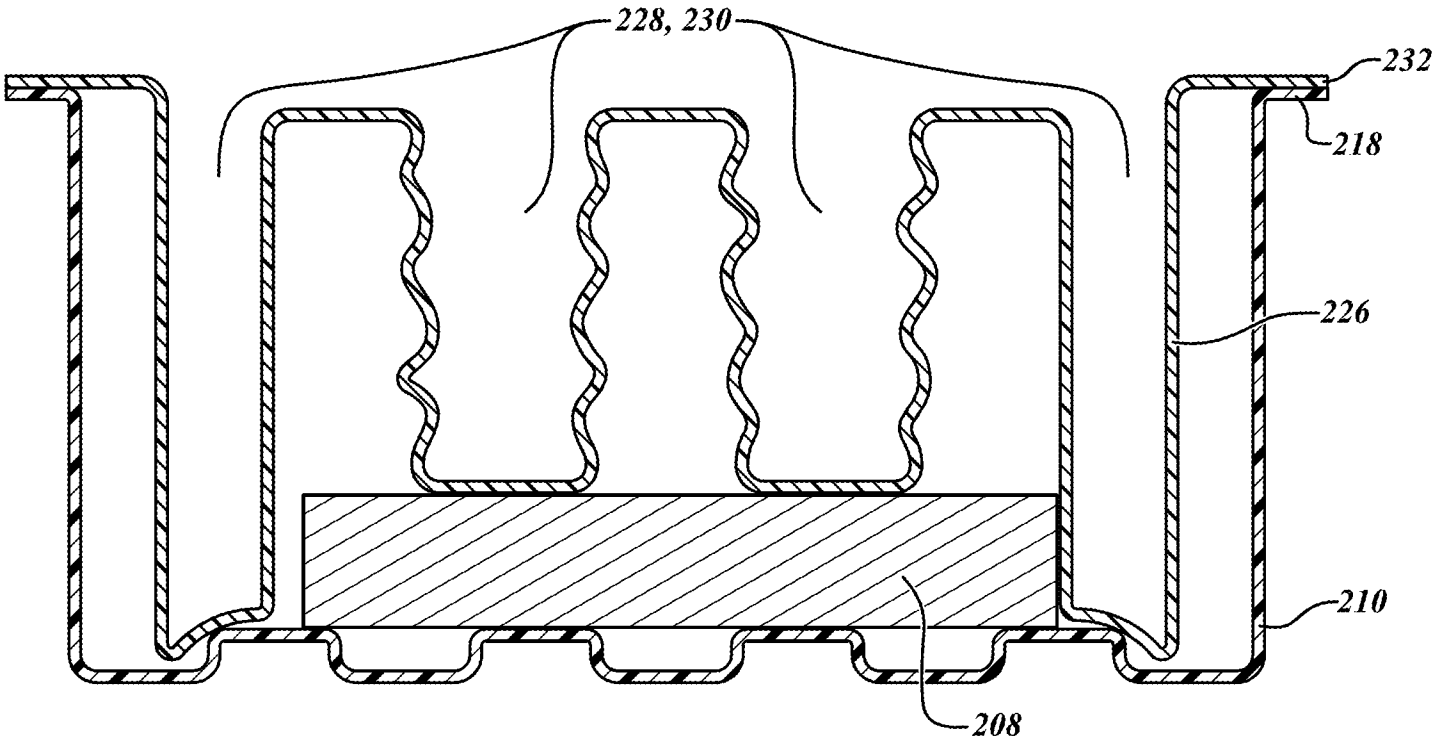
FIG. 6A is a side cross-sectional view of an outer tray, in which an item is placed, on which an inner tray is placed, corresponding to a package at time T2 in FIG. 2.

At time T2, the order 202 is received at the inner tray placement and vacuum seal station 222, which places an inner tray 226 over the item 208 and in the outer tray 210. To that end, the inner tray placement and vacuum seal station 222 may include an inner tray placement subsystem, which may include a movable arm 223 that may move vertically and/or horizontally, driven by an actuator, e.g., a linear actuator, to hold and place the inner tray 226 over the item 208 and in the outer tray 210. FIG. 5 is a top view of one example of the inner tray 226, and FIG. 6A is a side cross-sectional view of the inner tray 226 placed over the item 208 and in the outer tray 210. As shown in FIGS. 5 and 6A, the inner tray 226 includes multiple columnar compartments 228, 230 of various cross-sectional shapes. The inner tray 226 as illustrated in FIG. 5 includes four circular (in cross-section) compartments 228A (two on each side), four elliptical (or flattened circle) compartments 228B (two on each side), and five lateral beam compartments 230A and 230B that extend between the two sides of the inner tray 226. In the illustrated embodiment, of the five lateral beam compartments, three in the middle 230A are slightly longer in width but shorter in length than the other two lateral beam compartments 230B that sandwich the three lateral beam compartments 230A therebetween. As best shown in FIG. 6A, each of the compartments 228 (A, B) and 230 (A, B) has a closed end at the bottom and an open end at the top. Thus, when the inner tray 226 is placed over the item 208 and in the outer tray 210, each of the compartments 228 and 230 naturally contain air therein.

The inner tray 226 may be formed of any suitable and flexible (deformable) material, such as resin material, in particular, polypropylene (PP) material, PET or PET recycled material, for example. The inner tray 226 may be made of opaque material, or may be made of transparent material so that the ordered content can be visually confirmed from above. In one example, outer dimensions of the inner tray 226 generally correspond to those of the outer tray 210 (because the inner tray 226 is received within the outer tray 210) and are 25 mm in height, 235 mm in length and 190 mm in width at the top. In the illustrated example, the inner tray 226 includes a projecting rim (or brim) 232 having a width of 5 mm to 7 mm extending along the periphery at the top of the inner tray 226. The thickness of the inner tray 226 may be less than that of the outer tray 210 (having a thickness of about 450 μm, for example), and may be 100 μm, for example. While the inner tray 226 of the illustrated embodiment includes four circular compartments 228A, four elliptical compartments 228B, and five lateral beam compartments 230A and 230B, of course the shape(s), dimensions, number, and arrangement of the compartments 228, 230 are not limited to the illustrated embodiment. Different shapes (e.g., cross-sectional shapes), dimensions (e.g., a depth that the columnar compartments extend toward the bottom of the outer tray 210), numbers, and arrangement (e.g., a number of one or more shapes and their arrangement or combination) of the compartments 228, 230 may be selected and used depending on each application and implementation.

As shown in FIG. 6A, the projecting rim 232 of the inner tray 226 is dimensioned and arranged to be adhered or otherwise fixed to the projecting rim 218 of the outer tray 210, as will be more fully described below.

Still referring to FIG. 6A, because the inner tray 226, in particular its compartments 228, 230, are formed of flexible, deformable material, each of the compartments extends until its closed end at the bottom generally comes in contact with the item 208 placed in the outer tray 210 and/or with the bottom surface of the outer tray 210. In FIG. 6A, two outer compartments 228, 230 extend almost all the way toward the bottom of the outer tray 210 to contact (and support) the item 208 from its sides, while the other two compartments 228, 230 in the middle are compressed as they come in contact with (and support from the top) the top surface of the item 208. Thus, the plurality of compartments 228, 230 collectively enclose (wrap around) the ordered item 208. As will be more fully described below, each of the compartments 228, 230 will be closed at the top to form air compartments, resulting in multiple air compartments (or air cushions) collectively enclosing and protecting the ordered item 208.

Figure 6B:
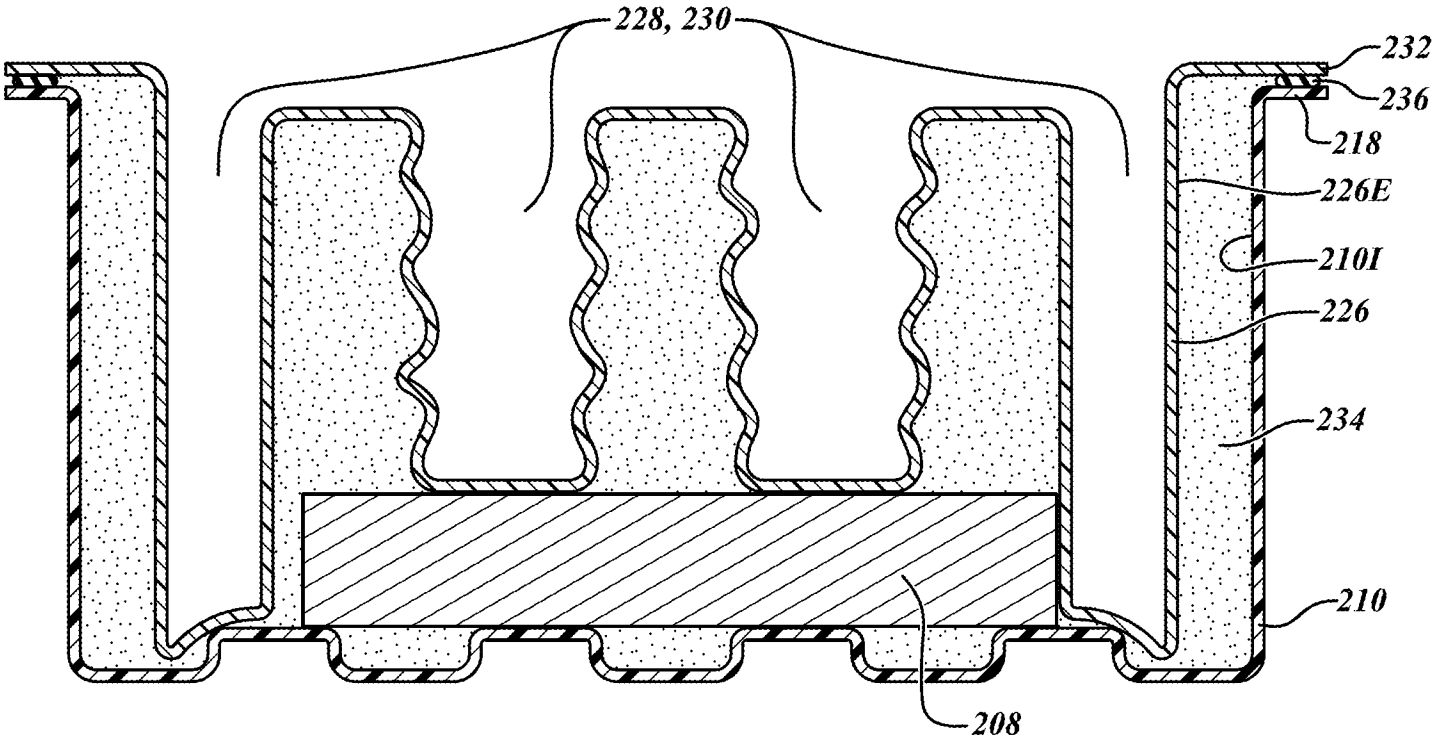
FIG. 6B is a side cross-sectional view of the outer tray, the item, and the inner tray, after the inner tray and the outer tray are sealed to each other while securing the item in at least a partial vacuum, still corresponding to the package at time T2 in FIG. 2.

As shown in FIG. 6B, after the inner tray 226 is placed over the item 208 and in the outer tray 210, the outer tray 210 and the inner tray 226 are sealed along their respective projecting rims 218 and 232. To this end, the inner tray placement and vacuum seal station 222 may include a vacuum sealer 225, which is coupled to the movable arm 223 and configured to seal the outer tray 210 and the inner tray 226 in at least a partial vacuum. As shown in FIG. 6B, the vacuum sealer 225 removes air from a space 234 between the outer tray 210 and the inner tray 226, which is shown as dotted section(s) in FIG. 6B. That is, at least a partial vacuum is formed in the space 234 between an exterior surface 226E of the inner tray 226 and an interior surface 2101 of the outer tray 210. The exterior surface 226E of the inner tray 226 may comprise a plurality of sub-surfaces of respective compartments 228, 230, and the interior surface 2101 of the outer tray 210 may comprise its bottom and side surfaces. In one embodiment, the air pressure within the space 234 is lowered to approximately 600 millibar to 700 millibar (where 1,013 millibar is approximately the atmospheric pressure at sea level). Thus, "vacuum" as used herein may include a partial vacuum having a pressure less than the atmospheric pressure. When sealed in at least a partial vacuum, the outer tray 210 and the inner tray 226 firmly secure the item 208 therebetween, such that the item 208 will not shift during shipment, for example. As shown in FIG. 6B, the inner tray 226 is at least partially deformed within the outer tray 210 because one or more of its compartments 228 and 230 come in contact with the item 208 placed in the outer tray 210 and are compressed.

In one embodiment, the vacuum sealer 225 seals the projecting rims 218 and 232 of the outer tray 210 and the inner tray 226 using adhesive material 236, e.g., easy-peel adhesive material. For example, the easy-peel adhesive material 236 may be applied at 150° C. heat seal temperature to form an adhesion having a torque value of about 1,000 gf-15 mm, which allows a customer to readily peel the inner tray's projecting rim 232 from the outer tray's projecting rim 218. Sample materials suitable as easy-peel adhesive material 236 include urethane polymers (polyurethanes), acrylate polymers (acrylics), etc. Other sealing methods, such as heat sealing without use of any adhesive material, sealing using tapes, etc. may also be used to seal the outer tray 210 and the inner tray 226 in at least a partial vacuum depending on each application and implementation.

Referring back to FIG. 2, after the item 208 is firmly secured in at least a partial vacuum between the outer tray 210 and the inner tray 226, the order 202 is conveyed to the shipping bill placement and covering station 224 at time T3. The shipping bill placement and covering station 224 is configured to place a shipping bill 238, or other documents or information related to the order, over the inner tray 226. (See additionally FIG. 6C.) For example, the shipping bill placement and covering station 224 may include a shipping bill placement subsystem, which may include a movable arm 227 that may move vertically and/or horizontally, driven by an actuator, e.g., a linear actuator, to hold and place the shipping bill 238 over the inner tray 226. The shipping bill placement and covering station 224 may also include a covering subsystem, which includes the movable arm 227 and a cover applicator 229 coupled to the movable arm 227 and configured to apply a top cover 240 over the inner tray 226. The cover applicator 229 is configured to fix the top cover 240 to the inner tray 226 along its projecting rim 232 using any suitable sealing method such as adhesive sealing or heat sealing. The cover 240 may be formed of any suitable flexible or rigid material, and may be transparent or may be opaque so that the contained item 208 is not visible from outside. In one example, the cover 240 may be formed of a resin material including polypropylene carbonate (PPC) and have a thickness of about 50 μm. The dimensions, shapes and materials of the cover 240 are not limited to those of the illustrated embodiment. Different dimensions (e.g., a thickness), shapes, and materials of the cover 240 may be selected, in view of the dimensions, shapes and materials of the inner tray 226 and the outer tray 210 to which the cover 240 is applied.

Figure 6C:
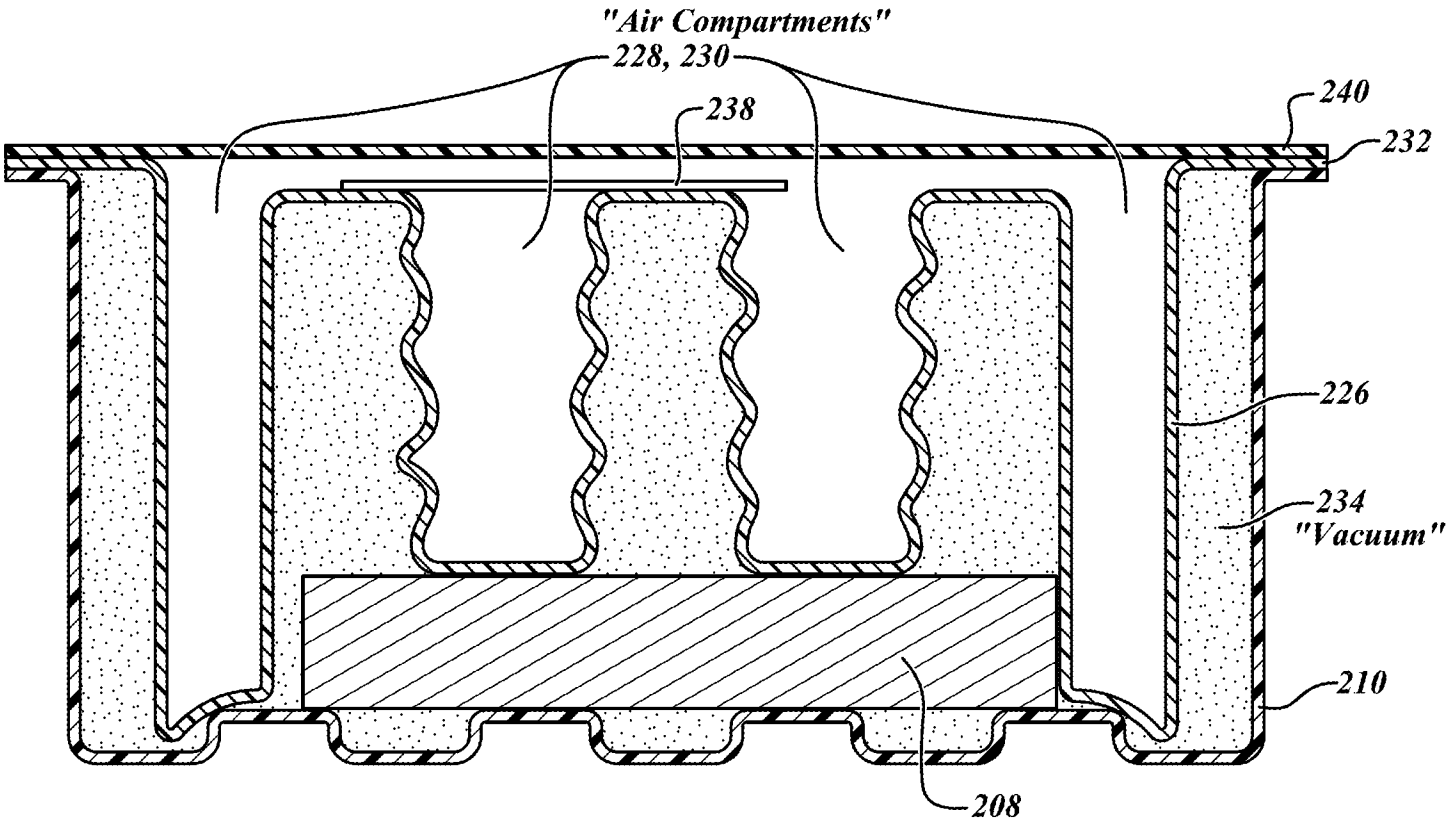
FIG. 6C is a side cross-sectional view of the outer tray, the item, the inner tray, and additionally a cover applied over the inner tray to close multiple compartments of the inner tray, to thereby form multiple "air compartments", corresponding to the package at time T3 in FIG. 2.

As shown in FIG. 6C, the cover applicator 229 places the cover 240 over the inner tray 226, in particular its multiple compartments 228, 230, and fixes the cover 240 to the inner tray 226 along its projecting rim 232, to thereby form multiple air compartments having the atmospheric pressure (e.g., 1,013 millibar). Thus, each of the compartments 228, 230 becomes an air compartment, or an air cushion, and the multiple air compartments 228, 230 collectively enclose and protect the item 208 from external impact.

In the completed package, as shown in FIG. 6C, the combination of at least a partial vacuum in the space 234 and the air compartments 228, 230 having the atmospheric pressure firmly secures the item 208 in the package and at the same time protects the item 208 from external impact. According to various exemplary embodiments, the package formed according to the present invention may withstand up to approximately 180 kg-f of force applied from outside, both from the top and the sides. In an exemplary embodiment, up to about 4 kg of item(s) can be securely placed and protected from external shock in the package formed according to the present invention.

Figure 7:
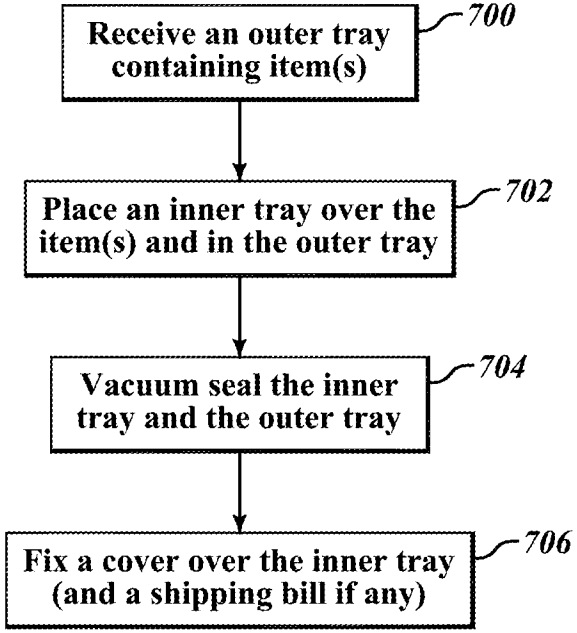
FIG. 7 is a flow chart of a method for automatically packaging item(s) according to an embodiment of the invention.

FIG. 7 is a flow chart illustrating steps performed in a method for automatically packaging item(s) according to one embodiment of the present invention. In step 700, an outer tray 210 including one or more ordered items 208 is received, as shown at time T1 in FIG. 2. In step 702, an inner tray 226 is placed over the item(s) 208 and in the outer tray 210 as shown in FIG. 6A. In step 704, the inner tray 226 and the outer tray 210 are sealed in at least a partial vacuum to firmly secure the ordered item(s) 208 therebetween, as shown in FIG. 6B. The steps 702 and 704 are performed at time T2 in the time sequence of the packaging process as illustrated in FIG. 2. In step 706, a cover 240 is applied over the inner tray 226 and fixed thereto, forming air compartments or air cushions, and enclosing a shipping bill 238, if any, therebetween as shown in FIG. 6C and as shown at time T3 in FIG. 2. The package is complete at this point.

As described above, the inner tray placement and vacuum seal station 222 and the shipping bill placement and covering station 224, or modifications thereof, are provided along the conveyor belt 200 that carries outer trays 210 each including one or more ordered items 208. At least some of the mechanisms installed in these stations 222, 224 may be simple enough such that they may be activated solely based on a cam mechanism driven by the rotation and movement of the conveyor belt 200. For example, a linear actuator configured to move the arm 223 or the arm 227 of the stations may be activated solely with a cam mechanism, which translates linear motion of the conveyor belt 200 along the extending direction of the conveyor belt 200 into rotary motion and then into linear vertical motion in the direction perpendicular to the plane of the conveyor belt 200 to move up and down the arm 223 or the arm 227. Alternatively or additionally, other types of mechanisms included in the stations 222, 224 require both driving power and a control signal for their proper operation. Thus, according to various embodiments of the invention, one or more of these stations configured to carry out a method of automatically packaging item(s) are configured to receive driving power as well as a control signal via the conveyor belt 200. Alternatively, each of the stations may be provided with a power supply needed to activate mechanism(s) installed thereon. Further additionally or alternatively, a control signal for controlling operation of the stations may be transmitted, e.g., wirelessly, from the control system 102 (see FIG. 1). The control system 102 may include, but is not limited to, one or more computer systems, one or more data storage devices, one or more wired and/or wireless networks, and control system software (programs, modules, drivers, user interfaces, etc.). An exemplary computer system 800 that may be used in the control system 102 is illustrated in FIG. 8.

Figure 8:
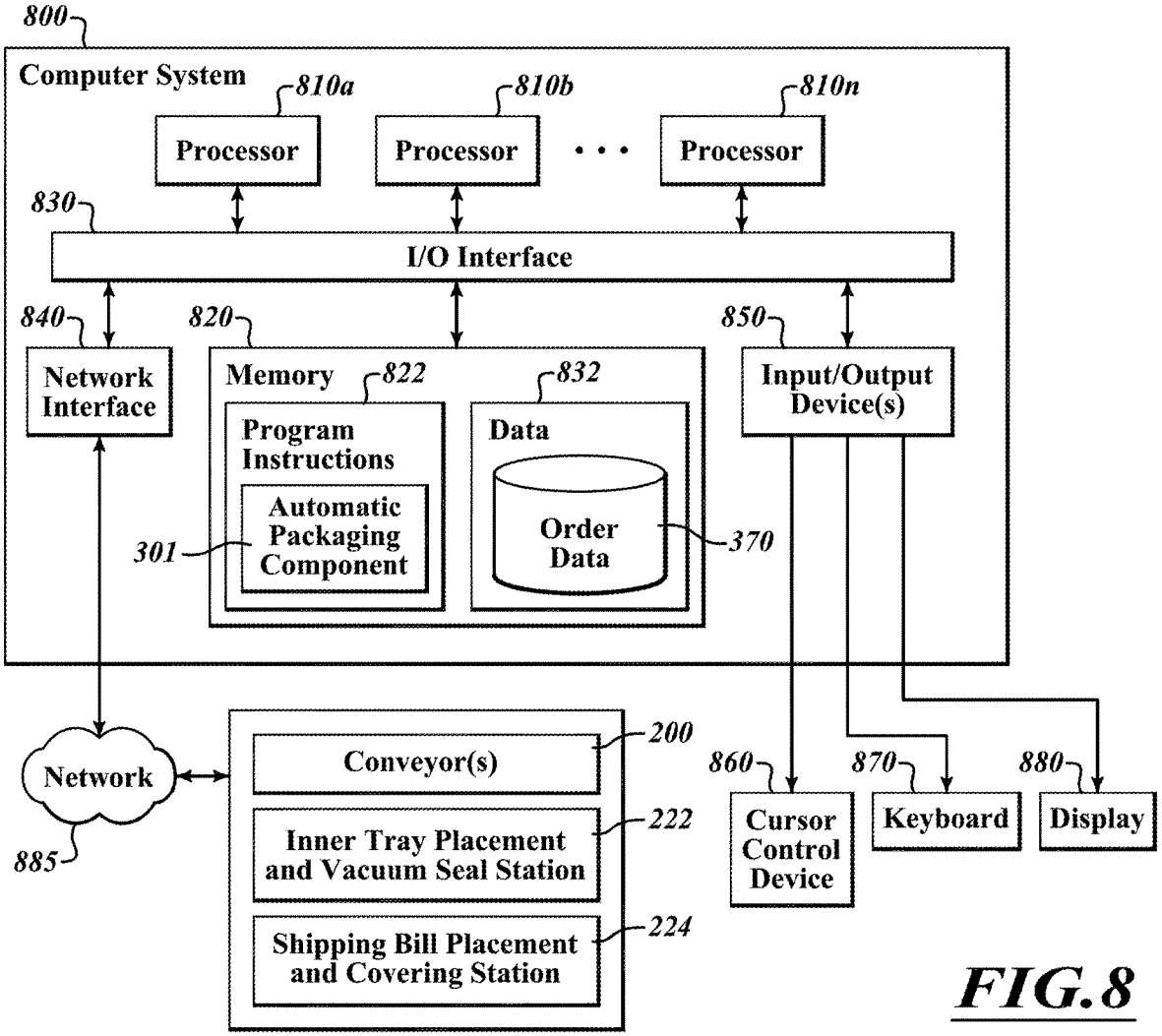
FIG. 8 is one example of a computer system suitable for implementing a system and method for automatically packaging item(s), using a conveyor belt in an order fulfillment facility, according to some embodiments.

Various embodiments of a system including a conveying device, e.g., a conveyor belt, for automatically packaging item(s) in an order fulfillment facility, as described herein, may be controlled by computer system 800 of FIG. 8. In the illustrated embodiment, computer system 800 includes one or more processors 810*a* to 810*n* coupled to a system memory 820 via an input/output (I/O) interface 830. Computer system 800 further includes a network interface 840 coupled to I/O interface 830, and one or more input/output devices 850, such as cursor control device 860, keyboard 870, and display(s) 880. In some cases, it is contemplated that embodiments may be implemented using a single instance of computer system 800, while in other embodiments multiple such systems, or multiple nodes making up computer system 800, may be configured to host different portions or instances of embodiments. For example, in one embodiment some elements may be implemented via one or more nodes of computer system 800 that are distinct from those nodes implementing other elements.

In various embodiments, computer system 800 may be a uniprocessor system including one processor 810, or a multiprocessor system including several processors 810 (e.g., two, four, eight, or another suitable number). Processors 810 may be any suitable processor capable of executing instructions. For example, in various embodiments processors 810 may be general-purpose or embedded processors implementing any of a variety of instruction set architectures (ISAs), such as the x86, PowerPC, SPARC, or MIPS ISAs, or any other suitable ISA. In multiprocessor systems, each of processors 810 may commonly, but not necessarily, implement the same ISA.

System memory 820 may be configured to store program instructions 822 and/or data 832 accessible by processor 810. In various embodiments, system memory 820 may be implemented using any suitable memory technology, such as static random access memory (SRAM), synchronous dynamic RAM (SDRAM), nonvolatile/Flash-type memory, or any other type of memory. In the illustrated embodiment, program instructions 822 include an automatic packaging component 301 for implementing control over the inner tray placement and vacuum seal station 222 and the shipping bill placement and covering station 224, or any other stations, as well as the conveyor belt 200. For example, the automatic packaging component 301 may include instructions for controlling the movement of the conveyor belt 200, for controlling movement of the arm 223 of the station 222 to place an inner tray 226 in an outer tray 210, for controlling operation of the vacuum sealer 225 to seal the inner tray 226 and the outer tray 210 in at least a partial vacuum (with application of adhesive material therebetween), for controlling movement of the arm 227 of the station 224 to place a shipping bill 238 (if any) over the inner tray 226, and for controlling operation of the cover applicator 229 to apply and fix a cover 240 to the inner tray 226. Data 832 of memory 820 may include order data 370, used to keep track of various orders that are respectively prepared into packages for shipment by the system and method for automatically packaging item(s) according to embodiments of the present invention. In some embodiments, program instructions and/or data may be received, sent or stored upon different types of computer-accessible media, e.g., non-transitory computer-readable media, or on similar media separate from system memory 820 or computer system 800.

In one embodiment, I/O interface 830 may be configured to coordinate I/O traffic between processor 810, system memory 820, and any peripheral devices in the device, including network interface 840 or other peripheral interfaces, such as input/output devices 850. In some embodiments, I/O interface 830 may perform any necessary protocol, timing or other data transformations to convert data signals from one component (e.g., system memory 820) into a format suitable for use by another component (e.g., processor 810). In some embodiments, I/O interface 830 may include support for devices attached through various types of peripheral buses, such as a variant of the Peripheral Component Interconnect (PCI) bus standard or the Universal Serial Bus (USB) standard, for example. In some embodiments, the function of I/O interface 830 may be split into two or more separate components, such as a north bridge and a south bridge, for example. Also, in some embodiments some or all of the functionality of I/O interface 830, such as an interface to system memory 820, may be incorporated directly into processor 810.

Network interface 840 may be configured to allow data to be exchanged between computer system 800 and other devices attached to a network 885, including conveyor(s) 200 and various stations including the inner tray placement and vacuum seal station 222 and the shipping bill placement and covering station 224. Network 885 may in various embodiments include one or more wired or wireless networks including but not limited to Local Area Networks (LANs) (e.g., an Ethernet or corporate network), Wide Area Networks (WANs) (e.g., the Internet), wireless data networks, some other electronic data network, or some combination thereof. In various embodiments, network interface 840 may support communication via wired or wireless general data networks such as any suitable type of Ethernet network, via telecommunications/telephony networks such as analog voice networks or digital fiber communications networks, via storage area networks such as Fibre Channel Storage Area Networks (SANs), or via any other suitable type of network and/or protocol.

Input/output devices 850 may, in some embodiments, include one or more display terminals, keyboards, keypads, touchpads, scanning devices, voice or optical recognition devices, or any other devices suitable for entering or accessing data by one or more computer systems 800. Multiple input/output devices 850 may be present in computer system 800 or may be distributed on various nodes of computer system 800. In some embodiments, similar input/output devices may be separate from computer system 800 and may interact with one or more nodes of computer system 800 through a wired or wireless connection, such as over network interface 840.

Those skilled in the art will also appreciate that some or all of the system components or data structures may be stored (e.g., as instructions or data) on a computer-accessible medium or a portable article, e.g., a non-transitory computer readable medium, to be read by an appropriate drive or processor, various examples of which are described above. In some embodiments, instructions stored on a computer-accessible medium separate from computer system 800 may be transmitted to computer system 800 via transmission media or signals such as electrical, electromagnetic, or digital signals, conveyed via a communication medium such as a network and/or a wireless link. Various embodiments may further include receiving, sending or storing instructions and/or data implemented in accordance with the foregoing description upon a computer accessible medium. Generally speaking, a computer-accessible medium may include a computer-readable storage medium or memory medium such as magnetic or optical media, e.g., disk or DVD/CD-ROM, volatile or non-volatile media such as RAM (e.g. SDRAM, DDR, RDRAM, SRAM, etc.), ROM, etc.

Various modifications and changes may be made as would be understood by a person skilled in the art having the benefit of this disclosure. The various embodiments described herein are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of the claims that follow. Finally, structures and functionality presented as discrete components in the exemplary configurations may be implemented as a combined structure or component. These and other variations, modifications, additions, and improvements may fall within the scope of embodiments of the present application.

What is claimed is:

1. A package, comprising;

an outer tray configured to contain an item therein;

an inner tray configured to be received within the outer tray over the item contained in the outer tray, the inner tray including a plurality of preformed columnar compartments that are deformable relative to one of surfaces of the outer tray in response to contacting the item, wherein the inner tray is sealed with the outer tray to form at least a partial vacuum between an exterior surface of the inner tray and an interior surface of the outer tray to vacuum seal the item between the outer and inner trays; and a cover placed over the inner tray to seal the plurality of preformed columnar compartments to thereby form a plurality of pressurized air compartments that enclose the item with at least one of the pressurized air compartments pressed against the item.

2. The package of claim 1, wherein a first pressure in the at least partial vacuum is approximately 600 millibar to 700 millibar, and a second pressure in the plurality of air compartments is approximately 1,013 millibar.

3. The package of claim 1, wherein the outer tray and the cover are formed of opaque material, and the inner tray is formed of transparent material.

4. The package of claim 1, wherein the inner tray is formed of polypropylene (PP) material, and a thickness of the inner tray is approximately 100 μm.

5. The package of claim 4, wherein the outer tray is formed of polyethylene terephthalate (PET) material and a thickness of the outer tray is approximately 450 μm.

6. The package of claim 1, wherein the inner tray and the outer tray are sealed with adhesive to form an adhesion between the inner tray and the outer tray.

7. The package of claim 6, wherein the adhesion has a torque value of approximately 1,000 gf-15 mm.

8. The package of claim 6, wherein the adhesion is formed along rims of the inner tray and the outer tray.

9. The package of claim 8, wherein each of the inner tray and the outer tray has a respective projecting rim, and the adhesive is applied between the respective projecting rims.

10. The package of claim 1, wherein the plurality of preformed columnar compartments include at least one compartment having a circular cross-section, at least one compartment having an elliptical cross-section, and at least one compartment having a beam cross-section.

11. The package of claim 1, wherein the inner tray is at least partially deformed within the outer tray upon contact with at least one of the outer tray or the item contained therein.

12. A system for automatically packaging items in a package, comprising:

an outer tray on a support, the outer tray containing one or more items;

a first station configured to place an inner tray within the outer tray over the one or more items contained in the outer tray, the inner tray including a plurality of preformed columnar compartments that are deformable relative to one of surfaces of the outer tray in response to contacting the one or more items, and to seal the inner tray and the outer tray to form at least a partial vacuum between an exterior surface of the inner tray and an interior surface of the outer tray to vacuum seal the one or more items between the outer and inner trays; and a second station configured to place a cover over the inner tray to seal the plurality of preformed columnar compartments to thereby form a plurality of pressurized air compartments that enclose the one or more items with at least one of the pressurized air compartments pressed against the one or more items.

13. The system of claim 12, wherein the support comprises a conveyor.

14. The system of claim 13, wherein the first station is positioned upstream of the second station along the conveyor, and the system further including a central controller configured to control operation of the conveyor, the first station, and the second station.

15. The system of claim 12, wherein the first station includes a sealer configured to form the at least partial vacuum having a pressure of approximately 600 millibar to 700 millibar.

16. The system of claim 12, wherein the first station is configured to seal the inner tray and the outer tray with adhesive to form an adhesion between the inner tray and the outer tray.

17. The system of claim 12, wherein the first station and the second station form a single station.

18. A method of automatically packaging items in a package, comprising:

(i) receiving an outer tray containing one or more items;

(ii) placing an inner tray in the outer tray over the one or more items contained in the outer tray, the inner tray including a plurality of preformed columnar compartments that are deformable relative to one of surfaces of the outer tray in response to contacting the one or more items;

(iii) sealing the inner tray and the outer tray to form at least a partial vacuum between an exterior surface of the inner tray and an interior surface of the outer tray to vacuum seal the one or more items between the outer and inner trays; and (iv) placing a cover over the inner tray to seal the plurality of preformed columnar compartments to thereby form a plurality of pressurized air compartments that enclose the item with at least one of the pressurized air compartments pressed against the one or more items.

19. The method of claim 18, wherein step (iii) comprises forming the at least partial vacuum having a pressure of approximately 600 millibar to 700 millibar.

20. The method of claim 18, wherein step (iii) comprises sealing the inner tray and the outer tray with adhesive to form an adhesion between the inner tray and the outer tray.

* * * * *